United States Patent [19]

Martin et al.

[11] 4,073,480

[45] Feb. 14, 1978

[54] APPARATUS FOR THE PROCESSING OF SLAG

[75] Inventors: Johannes Josef Martin; Erich Weber, both of Munich, Germany

[73] Assignee: Josef Martin Feuerungsbau GmbH, Munich, Germany

[21] Appl. No.: 797,515

[22] Filed: May 13, 1977

[30] Foreign Application Priority Data

May 21, 1976 Germany ..... 2622964

[51] Int. Cl.[2] ..... C21C 7/00

[52] U.S. Cl. ..... 266/201

[58] Field of Search ..... 75/24, 30; 214/29, 30; 266/195, 201, 236, 122, 130

[56] References Cited

U.S. PATENT DOCUMENTS

| | | | |
|---|---|---|---|
| 1,626,292 | 4/1927 | Lund | 266/201 |
| 2,286,078 | 6/1942 | Gallai-Hatchard | 266/201 |

*Primary Examiner*—Gerald A. Dost
*Attorney, Agent, or Firm*—Peter K. Kontler

[57] ABSTRACT

Apparatus for processing slag, which is quenched in a liquid-containing vessel, has a forwardly and upwardly sloping chute receiving batches of quenched slag through the medium of a first pusher which is reciprocable along the bottom of the vessel whereby the chute accumulates a column of slag which overflows at the discharge end of the chute. The overflowing slag descends onto the upper side of a first forwardly and upwardly inclined bottom wall in front of a second reciprocable pusher which performs a forward stroke when the first pusher performs a return stroke and vice versa. The second pusher spreads and advances the slag toward and beyond the discharge end of the first bottom wall so that the slag descends onto a second bottom wall which is swept by a third reciprocable pusher. Liquid which is entrained by slag leaving the quenching vessel is permitted to flow rearwardly and downwardly along the bottom of the chute as well as along the two bottom walls so that the material which overflows the second bottom wall is practically free of liquid. Smaller particles of slag which remain entrapped in the liquid descend onto the second bottom wall and are swept rearwardly and downwardly by one or more scrapers which are reciprocated by the third pusher and are lifted off the second bottom wall during forward movement of the third pusher.

23 Claims, 3 Drawing Figures

APPARATUS FOR THE PROCESSING OF SLAG

BACKGROUND OF THE INVENTION

The present invention relates to the treatment of slag in industrial furnaces or the like, and more particularly to improvements in apparatus for quenching and further processing of slag. Still more particularly, the invention relates to improvements in apparatus of the type wherein slag which issues from a furnace (e.g., a slag tap furnace) is fed into a liquid-containing quenching vessel and is thereupon evacuated from the vessel into a chute or duct to overflow at the discharge end of the chute.

In many presently known slag processing apparatus, quenched slag is evacuated from the vessel by a piston or pusher which advances batches of slag from the liquid bath into and along the upwardly sloping bottom of the chute. The material which overflows at the discharge end of the chute is caused to descend onto a conveyor (e.g., a belt conveyor) or directly into a vehicle. The length of the chute is limited, i.e., such length cannot be increased at will, because of the damming effect of wet material which is advanced from the liquid bath toward the discharge end and also because the bottom of the chute slopes upwardly in order to insure that a substantial percentage of liquid which is entrained from the bath returns into the vessel by flowing counter to the direction of movement of slag. In certain industrial furnaces, the construction of parts which receive and convey molten slag to the quenching vessel is such that the mechanism or conveyance for transport of slag away from the furnace must be located at a considerable distance from the quenching station. This can be achieved by utilizing a relatively long chute and/or by placing the discharge end of the chute at a level well above the inlet, i.e., well above the quenching bath, and by employing one or more horizontal or slightly sloping belt conveyors, vibratory conveyors or scraper conveyors for further transport of slag which overflows the discharge end of the chute. Such mode of manipulating quenched slag is satisfactory as long as the slag need not be relieved of all, or a high percentage of, liquid which is entrained from the quenching vessel. The need for complete or practically complete segregation of quenched slag from liquid will arise when the slag must be loaded onto trucks or other types of vehicles in a cold climate or during the winter months because the liquid which drips from the trucks is likely to freeze on the road surface and renders the driving hazardous. Moreover, certain types of conveyors which are presently in use for transport of slag that overflows at the discharge end of an upwardly sloping chute are not entirely satisfactory. For example, a scraper conveyor is likely to undergo pronounced wear.

OBJECTS AND SUMMARY OF THE INVENTION

An object of the invention is to provide a novel and improved apparatus which can effect complete or practically complete segregation of quenched slag from liquid.

Another object of the invention is to provide an apparatus wherein the transport and segregation of slag from liquid can be effected by resorting to simple instrumentalities which are not subjected to extensive wear.

A further object of the invention is to provide an apparatus which can spread quenched and demoisturized slag evenly on the surface or surfaces of devices which serve to advance slag to storage or to a further processing station.

An additional object of the invention is to provide an apparatus which can process large quantities of slag per unit of time and which can salvage small as well as minute particles of slag from the segregated liquid.

An ancillary object of the invention is to provide the apparatus with novel and improved means for treating slag downstream of the chute which receives slag directly from the quenching vessel.

A further object of the invention is to provide an apparatus which can be installed in existing industrial furnaces as a superior substitute for presently known slag processing apparatus.

The invention resides in the provision of an apparatus for processing slag which issues from an industrial furnace or the like. The apparatus comprises a liquid-containing quenching vessel for reception of slag (e.g., from a conduit which conveys molten slag from the furnace), a chute or duct having an inlet in communication with the vessel and a discharge end remote from the inlet, means (e.g., a reciprocable pusher) for advancing batches of quenched slag from the vessel into the duct so that the slag is caused to overflow at the discharge end of the duct, and means for transporting the overflowing slag. The transporting means includes an elongated receptacle having a rear portion below the discharge end of the duct to receive overflowing slag and a front portion at a level above the rear portion, a pusher which is reciprocable between a retracted position behind the discharge end of the duct and a forward or extended position, and one or more fluid-operated motors or analogous means for reciprocating the pusher between the retracted and forward positions so that the pusher advances overflowing slag in the receptacle toward the front portion during each movement from the retracted position.

The reciprocating means preferably includes means for moving the pusher between the retracted and forward positions at a first frequency, and the advancing means preferably comprises a second pusher which is reciprocable between retracted and forward positions to advance a batch of slag from the liquid bath in the vessel toward the discharge end of the duct during each forward stroke, and means for reciprocating the second pusher at a second frequency. The first frequency is preferably $n$ times the second frequency (wherein $n$ is a whole number including one), and the two reciprocating means preferably further comprise means for maintaining the first mentioned pusher in the retracted position when the second pusher approaches or reaches its forward position and vice versa.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figure 1:
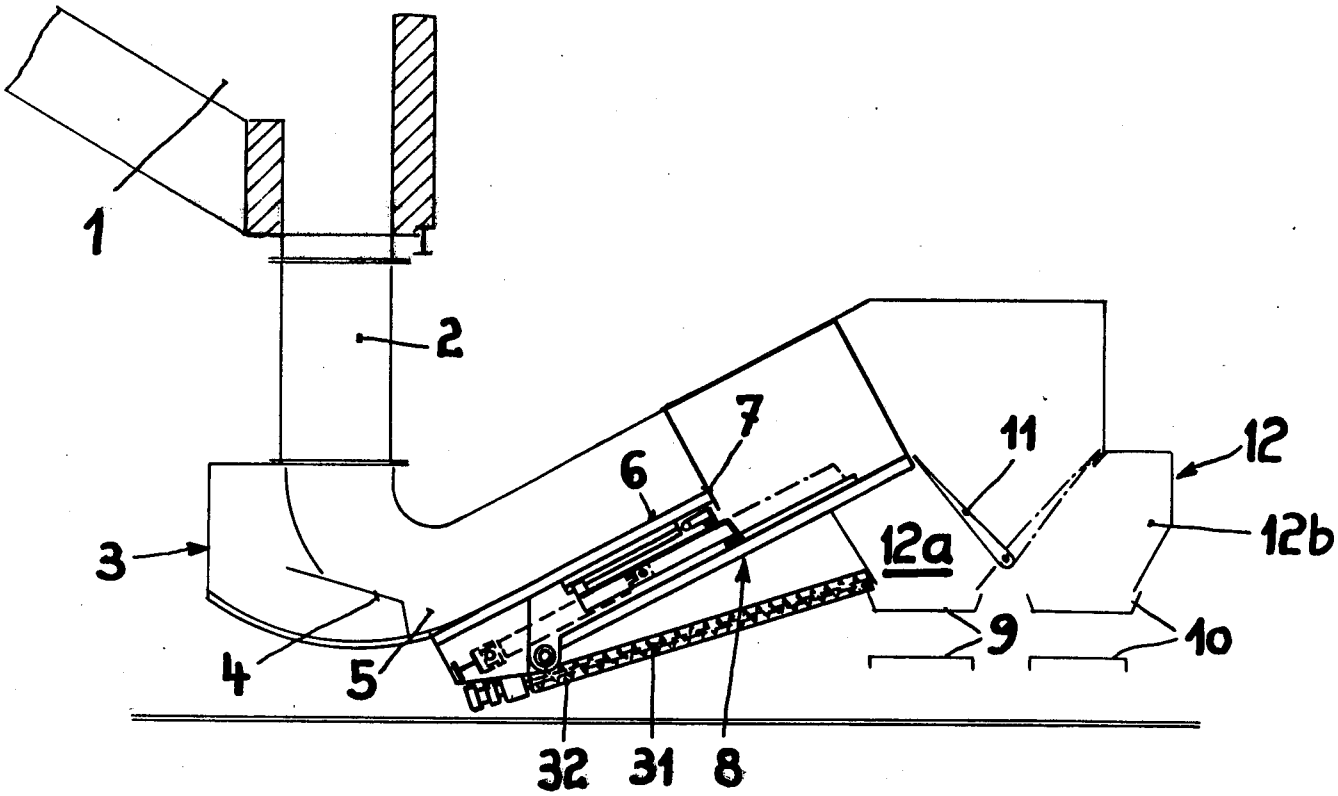
FIG. 1 is a schematic longitudinal vertical sectional view of an apparatus which embodies one form of the invention and comprises a single transporting unit.

FIG. 1 shows a slag tap furnace 1 which has a downwardly extending conduit 2 for admission of molten slag into a quenching vessel or tank 5 forming part of a slag removing apparatus 3. The vessel 5 has an arcuate bottom wall and contains a supply of quenching liquid. Quenched slag is removed from the vessel 5 by a reciprocable advancing member or pusher 4 which feeds batches of quenched slag into and beyond the inlet of an upwardly sloping chute or duct 6 having a discharge end 7 located at a level above the inlet. The discharge end 7 defines an overflow edge for the foremost increments of a continuous column of slag which fills or nearly fills the upper portion of the chute 6. The strokes of the pusher 4 between its retracted and extended or forward positions are selected in such a way that the pusher does not reach the discharge end 7, i.e., the pusher merely advances successive batches of quenched slag into the chute 6 whereby the aforementioned column advances toward and its leader overflows the discharge end 7.

The overflowing slag descends into the elongated receptacle of a transporting unit 8 wherein the material is advanced upwardly and overflows into a magazine or bin 12 having two compartments 12*a* and 12*b*. The bottom wall of the left-hand compartment 12*a* constitutes the upper reach of an endless evacuating conveyor 9 (e.g., a belt or chain conveyor) which advances slag toward a loading station, e.g., above the platform of a waiting truck which transports slag to a further processing station or to storage. The bottom wall of the compartment 12*b* constitutes the upper reach of a second endless evacuating conveyor 10 which can transport slag to the same destination as the conveyor 9 or to another loading station. A gate 11 in the magazine 12 is pivotable between the illustrated (solid-line) position in which the material overflowing at the discharge end of the receptacle in the transporting unit 8 is compelled to enter the compartment 12*b* and a second position (indicated by phantom lines) in which the overflowing material enters the compartment 12*a*. The arrangement may be such that the conveyor 10 is in operation while the conveyor 9 is idle and the compartment 12*a* is in the process of being filled with slag, and that the conveyor 9 is in motion to gradually evacuate the contents of the compartment 12*a* while the conveyor 10 is idle and the overflowing slag enters the compartment 12*b*. However, it is equally possible to drive the conveyors 9 and 10 at all times or to drive only that conveyor whose upper reach receives slag from the transporting unit 8.

The conveyor 9 and/or 10 can be replaced with a vibratory conveyor or with any other evacuating device which can transport slag to the next processing station, to a loading station or to storage.

The transporting unit 8 prolongs the path along which quenched slag moves on its way to the magazine 12. This enables the liquid which is entrained from the chute 6 to flow backwards along the bottom wall of the receptacle of the unit 8 and into a collecting trough, such as the trough 29 shown in FIG. 2. It has been found that the interposition of transporting unit 8 between the chute 6 and the magazine 12 results in highly satisfactory segregation of liquid from slag so that the material which is advanced beyond the discharge end of the receptacle of the unit 8 can be loaded directly onto trucks or other types of conveyances, i.e., the magazine 12 can be omitted and the material which advances beyond the unit 8 can be caused to descend by gravity into the receptacle of an automotive vehicle. The quantity of liquid which enters the load-receiving portion of the vehicle is negligible.

Figure 2:
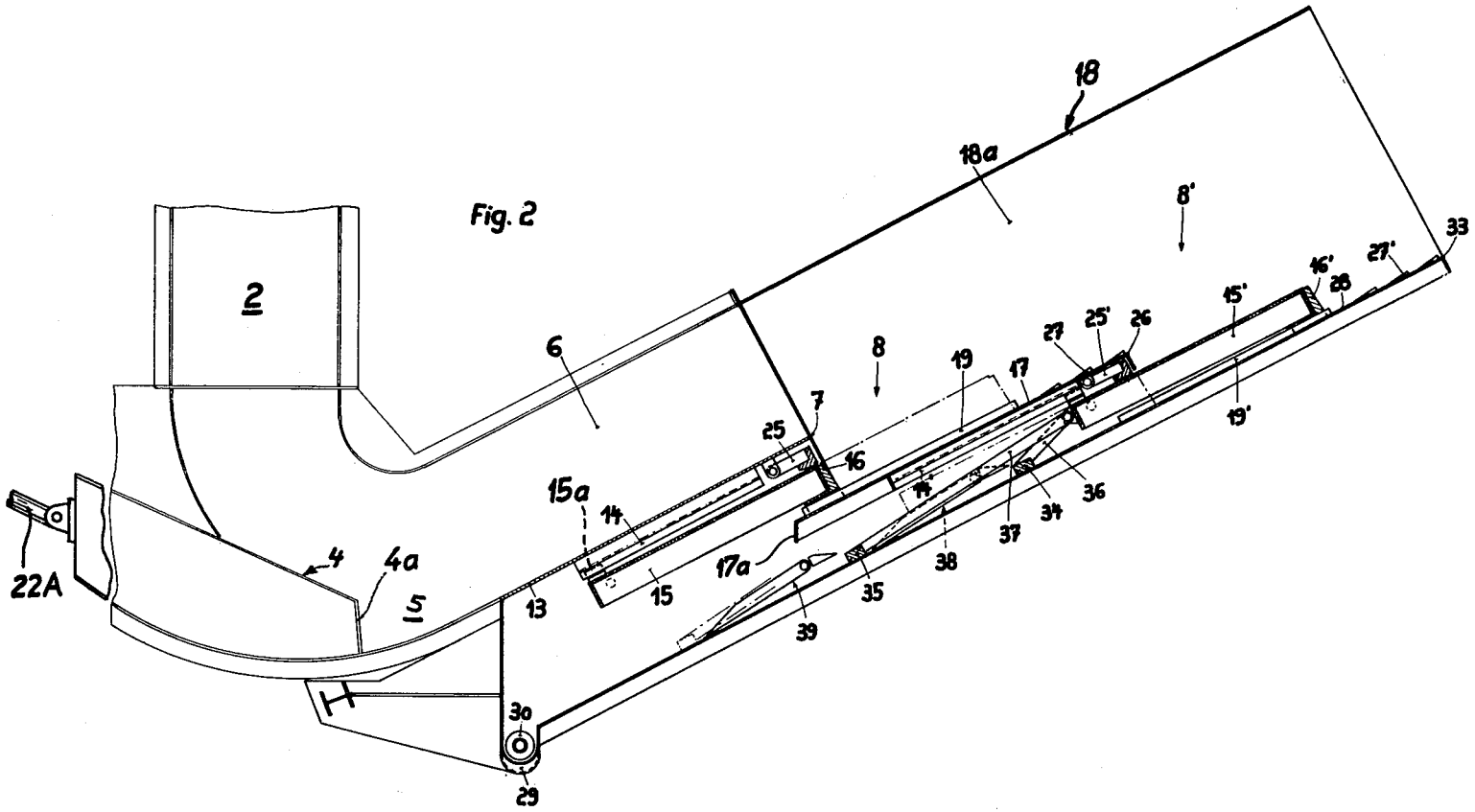
FIG. 2 is a longitudinal sectional view of a second apparatus with two transporting units.
Figure 3:
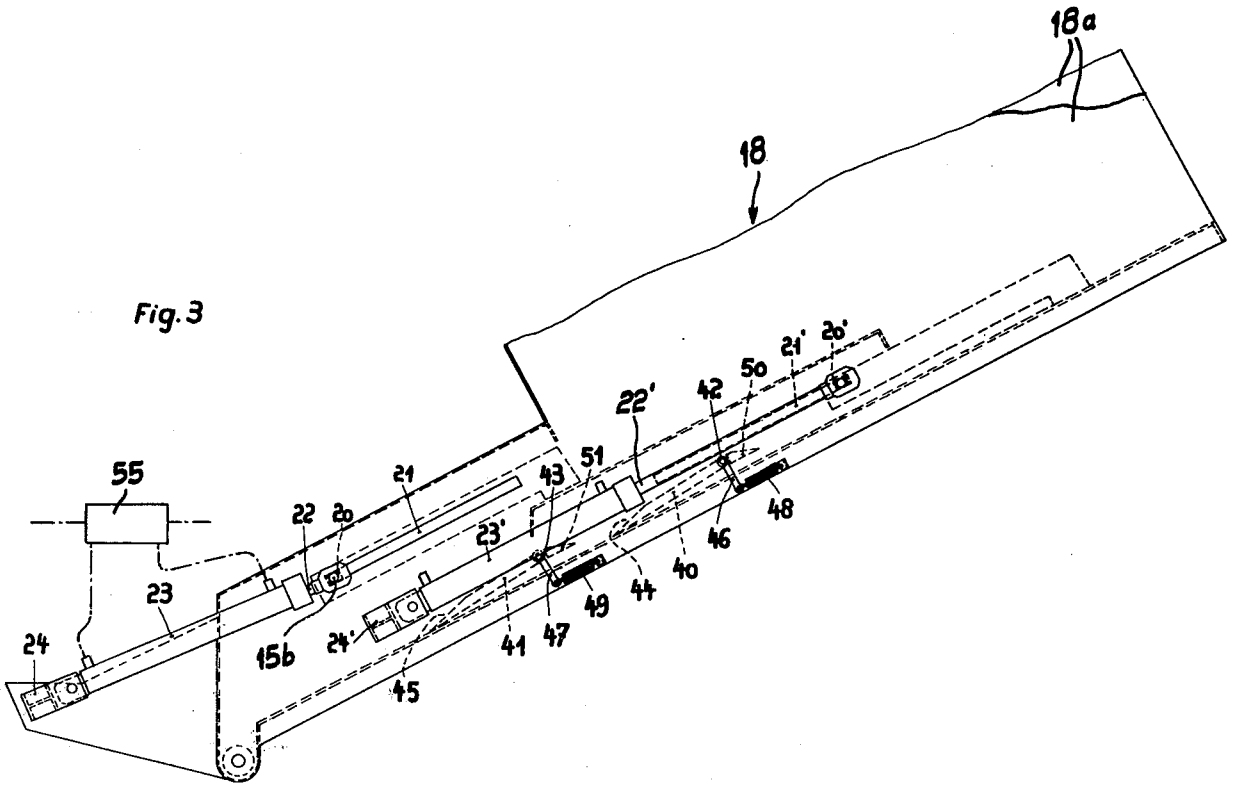
FIG. 3 is a side elevational view of the apparatus of FIG. 2.

A modified apparatus with two transporting units 8 and 8′ is shown in FIGS. 2 and 3. The duct or chute 6 comprises an upwardly and forwardly sloping bottom wall 13 along which some of the liquid (normally water) which is entrained from the vessel 5 by quenched slag when the pusher 4 performs a forward stroke (from the retracted to the extended or forward position) flows backwards into the vessel. The discharge end 7 of the chute 6 is located well above the level of the inlet of the chute and, as mentioned above, the stroke of the pusher 4 in a direction toward the discharge end 7 is shorter than the length of the bottom wall 13 so that the pusher causes the expelled material to pile up in the chute and to advance, substantially stepwise, toward and beyond the discharge end 7. Actually, the stroke of the pusher 4 can be longer than the chute 6; all that counts is to insure that the front surface 4*a* of the pusher is located behind the discharge end 7 when the pusher completes a forward stroke, i.e., when it reaches its extended position. The upper part of the chute 6 is completely filled with quenched slag and the column of slag in such upper part contains at least some liquid. The liquid is segregated from slag during transport by the unit 8′ and/or 8 so that the solid material which reaches the discharge end of the receptacle of the unit 8′ is substantially or completely free of liquid. The purpose of the transporting units 8 and 8′ is to lengthen the path of movement of slag in the apparatus, and more particularly in that portion of the apparatus wherein the liquid can be intercepted, collected and evacuated, either continuously or at desired or necessary intervals.

The transporting unit 8 comprises a receptacle including an upwardly and forwardly inclined bottom wall 17 and two side walls 18*a* forming part of an enclosure or tunnel 18. The rear portion of the bottom wall 17 of the receptacle is located below the discharge end 7 of the chute 6 and the forward portion of the bottom wall 17 has a discharge end formed by a wear-resistant overflow edge 26. The transporting unit 8 further comprises a pusher or plunger 15 which is movable between the retracted position (shown in FIG. 2 by solid lines) in which it is located behind the discharge end 7 and an extended or forward position which is indicated in FIG. 2 by phantom lines. It will be noted that, when the pusher 15 assumes its extended position, its front end is located at least slightly rearwardly of the overflow edge 26 at the discharge end of the front portion of the bottom wall 17. The means for guiding the pusher 15 during movement between retracted and forward positions comprises a rear guide 14 which is located below and is affixed to the bottom wall 13 of the chute 6. The rear guide 14 can constitute an inverted T-shaped rail which is tracked by a follower 15*a* at the rear end of the pusher 15. The front portion of the pusher 15 is provided with a wear-resistant liner or shoe 16 which lies on and slides along the upper side of the bottom wall 17. A second prismatic guide 19 of the guide means for the piston 15 extends upwardly from the bottom wall 17 and is preferably located substantially midway between the side walls 18*a*, the same as the guide 14. The guide 19 extends through a complementary slot or groove in the pusher 15 and its liner 16. The guides 14 and 19 confine the pusher 15 to reciprocatory movement between its retracted and extended positions.

The rear portion of the pusher 15 (the pusher preferably extends all the way between the two side walls 18*a* of the enclosure 18) is further provided with laterally outwardly extending pins 15*b* (see FIG. 3) which are received in slidable followers 20 movable along upwardly and forwardly inclined guide slots 21 machined into the side walls 18*a*. At least one of the pins 15*b* and/or the respective follower 20 is coupled to the piston rod 22 of a motor 23 here shown as a double-acting hydraulic or pneumatic cylinder and piston unit. The rear end of the cylinder of the motor 23 is articulately connected to the respective side wall 18*a* by a coupling element 24. The means for reciprocating the pusher 15 between the retracted and extended positions preferably comprises two motors 23, one at each side of the pusher.

The rear guide 14 for the pusher 15 is located immediately behind a stripping member 25 which is pivotably mounted at the underside of the bottom wall 13 directly behind the discharge end 7 and serves to remove slag from the upper side of the pusher 15 while the latter moves back toward its retracted position. The thus removed material falls onto the bottom wall 17 in front of the shoe 16 and is advanced toward the overflow edge 26 when the pusher 15 performs the next forward stroke. As shown in FIG. 2, the shoe 16 is located substantially at or close to the front end of the front guide 19 when the pusher 15 completes a forward stroke so that a certain quantity of slag remains on the bottom wall 17 in the region between the front end of the guide 19 and the edge 26 while the pusher 15 moves back toward the retracted position. Such material is caused to move forwardly and to advance toward and beyond the edge 26 while the pusher 15 performs the next forward stroke. Since the inclination of the bottom wall 17 is rather pronounced, the apparatus comprises means for preventing the material on the bottom wall 17 (in front of the guide 19) from sliding or rolling back toward the discharge end 7. In the embodiment of FIGS. 2 and 3, such movement preventing means includes suitably configurated (substantially wedge-like) protuberances or teeth 27 extending upwardly from the front portion of the bottom wall 17. The shorter flanks of teeth 27 face forwardly so that they intercept the particles which tend to slide or roll backwards toward the chute 6.

The underside of the pusher 15 is not in sealing engagement with the upper side of the bottom wall 17; therefore, liquid can readily flow backwards along the wall 17 and overflows at the rear end 17*a* to descend onto a lower bottom wall 28 which guides the liquid into the trough 29. The same applies for the pusher 4, i.e., liquid is free to flow along the upper side of the bottom wall 13 and to return into the vessel 5. Consequently, the material which overflows the edge 26 contains a very low percentage of liquid. The segregation of liquid from slag is facilitated by the spreading action of the pusher 15 which distributes the overflowing material along the full width of the bottom wall 17 so that the layer of material advancing toward the edge 26 is relatively thin and cannot entrap appreciable quantities of liquid.

The construction of the second or downstream transporting unit 8′ is analogous to that of the transporting unit 8, and all such parts of the second unit 8′ which are identical with or clearly analogous to corresponding parts of the unit 8 are denoted by similar reference characters each followed by a prime. The elongated receptacle of the unit 8′ comprises the upwardly and forwardly inclined bottom wall 28 having a front portion provided with protuberances 27′ and including a discharge end with an overflow edge 33. The pusher 15′ of the unit 8′ is shown in the forward or extended position, and it will be seen that the wear-resistant shoe or liner 16′ of the pusher 15′ (in the extended position) is spaced apart from the overflow edge 33 so that some material remains on the foremost portion of the bottom wall 28 when the pusher 15′ completes a forward stroke. The rear guide 14′ for the pusher 15′ is installed at the underside of the bottom wall 17 behind a pivotable stripping member 25′ which cleans the upper side of the pusher 15′ while the latter travels rearwardly so as to move its shoe 16′ below and behind the overflow edge 26 of the bottom wall 17. The front guide 19′ for the pusher 15′ is installed on the bottom wall 28 behind the protuberances 27′. The side walls of the receptacle for the pusher 15′ are the front portions of side walls 18*a* of the enclosure 18. The width of the pusher 15′ preferably equals or approximates the width of the pusher 15.

The pusher 15′ is not in sealing engagement with the bottom wall 28 so that the liquid which overflows the edge 26 and/or shoe 16′ can flow rearwardly toward the trough 29. This results in additional segregation of liquid from slag, and such segregation is promoted by the spreading action of the pusher 15′ which causes a further equalization of the layer of the slag that descends onto the bottom wall 28 in response to each forward stroke of the pusher 15. The spreading action of the pushers 15 and 15′ is desirable on the additional ground that the rate of material overflow at the edge 33 is more uniform. Such material can descend into a magazine (such as the magazine 12 of FIG. 1), onto one or more belt conveyors, chain conveyors or vibratory conveyors, or directly into the material-receiving containers of road vehicles.

Still further, uniform distribution of slag on the bottom walls 17 and 28 is desirable because this reduces the likelihood of excessive localized wear upon such parts.

The bottom wall 28 of the transporting unit 8′ extends downwardly and rearwardly below the unit 8 and all the way to a level below the inlet of the chute 6. The upper side of the bottom wall 28 serves to intercept liquid droplets or streams which are separated from slag by gravity, and the bottom wall 28 directs the thus intercepted liquid into the collecting trough 29 which extends transversely of the direction of reciprocatory movement of the pusher 4, 15 or 15′. The liquid which trickles along the upper side of the bottom wall 28 invariably or normally entrains smaller particles of slag. Such particles accumulate in and form a muddy mass in the bottom zone of the trough 29; therefore, the apparatus preferably comprises a feed screw 30 or another suitable conveyor whose axis is normal to the plane of FIG. 2 and which serves to evacuate the mud, either continuously or intermittently. This insures that the trough 29 is not clogged with slag. Furthermore, the smaller particles of slag are preferably evacuated from the apparatus and/or further processed together with the larger particles which leave the apparatus by overflowing at 33.

As shown in FIG. 1, the means for evacuating smaller particles of slag which descend below the transporting unit or units may further include a trough 32 which extends forwardly and upwardly to the compartment 12*a* of the magazine 12 from a first trough (not shown in FIG. 1 but corresponding to the trough 29 of FIG. 2). The trough 32 contains a feed screw 31 whose thread advances the muddy mass from the trough 29, i.e., from the discharge end of the trough 29, toward and onto the upper reach of the conveyor 9. The inclination of the trough 32 is such that the small particles of slag which are supplied to the compartment 12*a* by the feed screw 31 are practically free of liquid. If desired, the trough 32 may consist of foraminous material to further enhance the segregation of liquid from small particles of slag while such particles advance toward and onto the upper reach of the conveyor 9.

The means for reciprocating the pusher 15′ of the second transporting unit 8′ is shown in FIG. 3. Such reciprocating means preferably includes two fluid-operated motors 23′ whose cylinders are articulately coupled to the side walls 18*a*, as at 24′, and whose piston rods 22′ are attached to the respective followers 20′ which slide in the guide slots 21′ of the respective side walls 18*a*.

The second transporting unit 8′ further actuates means for entraining smaller particles of slag (namely, such particles which are too small to be advanced by the liner 16′ of the pusher 15′ while the latter performs a forward stroke) toward the trough 29 during each return stroke of the pusher 15′. Such entraining means also promotes the flow of liquid along the upper side of the bottom wall 28 and toward the trough 29. The entraining means comprises two elongated strip- or bar-shaped scrapers 34, 35 which lie upon and sweep the upper side of the bottom wall 28 while the pusher 15′ moves backwards but are lifted off the bottom wall 28 during each forward stroke of the pusher 15′. The scrapers 34, 35 are articulately connected to the rear end portion of the pusher 15′ by pivotable arms 36, 37. The scraper 35 is located behind the scraper 34, as considered in the direction of forward movement of the pusher 15′, and each of these scrapers preferably extends transversely of the entire bottom wall 28, i.e., all the way from the one to the other side wall 18*a* of the enclosure 18.

The means for lifting the scrapers 34, 35 off the bottom wall 28 during each forward stroke of the pusher 15′ comprises two ramps 38, 39 which are pivotably secured to the side walls 18*a* of the enclosure 18 and whose pointed (wedge-like) tips face rearwardly. When the pusher 15′ performs a rearward stroke, the scrapers 34, 35 slide along the bottom wall 28 to advance mud and liquid toward the trough 29 and to lift the respective ramps 38, 39 by pivoting them clockwise, as viewed in FIG. 2. When the pusher 15′ reaches its fully retracted position, the scrapers 34, 35 are located behind the tips of the respective ramps 38, 39 (the rearmost position of the scraper 35 is indicated by phantom lines) whereby the ramps are free to pivot anticlockwise and return their tips into contact with the upper side of the bottom wall 28. When the pusher 15′ thereupon moves forwardly, the scrapers 34, 35 slide along the upper sides of the respective ramps 38, 39 and are held at a level above the bottom wall 28.

The details of the ramps 38 and 39 are shown in FIG. 3. These ramps respectively comprise pairs of suitably configurated rails 40, 41 whose front end portions are turnable on pivot members 42, 43 and which are adjacent to the respective side walls 18*a*. The front portions of the rails 40, 41 are located above the paths of rearward movement of the respective scrapers 34, 35. The suitably configurated upper edge faces or cam faces of the rails 40, 41 are shown at 44 and 45. In order to insure that the pointed rear end portion of each rail invariably returns into abutment with the upper side of the bottom wall 28, as soon as the respective scraper assumes its rear end position, the rails 44, 45 are preferably connected with levers 46, 47 which are biased by springs 48, 49 tending to pivot the respective rails in an anticlockwise direction, as viewed in FIG. 3. The springs 48, 49 further insure that the trailing ends of the rails 40, 41 continue to abut against the bottom wall 28 during each forward stroke of the pusher 15′.

The rails 40, 41 are respectively provided with forwardly and downwardly sloping extensions or auxiliary ramps 50, 51 which guide the respective scrapers 34, 35 toward the upper side of the bottom wall 28 when the pusher 15′ is about to complete a forward stroke. The auxiliary ramps 50, 51 reduce the likelihood of extensive wear upon and/or damage to the bottom wall 28 and/or scrapers 34, 35 by insuring that the anticlockwise pivotal movement of scrapers 34, 35 toward the bottom wall 28 is gradual.

In FIG. 2, the pushers 15 and 15′ are respectively held in retracted and extended positions. When the pusher 15 reaches its extended position, the pusher 15′ reaches or already assumes its retracted position. This can be readily achieved by actuating the valves which admit pressurized fluid into and evacuate fluid from the cylinders 23 and 23′ at predetermined intervals. The same preferably applies for actuation of the pusher 4, i.e., this pusher is retracted when the pusher 15 assumes it extended or forward position, and vice versa. Such mode of operation insures that the material which overflows in response to a forward stroke of the preceding pusher falls in front of the next-following pusher.

The reciprocating means for the pusher 4 can be similar to the reciprocating means for the pusher 15 or 15′. FIG. 2 merely shows a piston rod 22A which is articulately connected to the rear end of the pusher 4. It is often desirable to move the preceding pusher (especially the pusher 4) at a frequency which is less than the frequency of reciprocatory movement of the next-following pusher. For example, the frequency of reciprocatory movement of the pusher 15 can be *n* times the frequency of reciprocatory movement of the pusher 4 (*n* is a whole number including one). If *n* exceeds one, the spreading or distributing action of the pusher 15 is even more uniform than if the number of reciprocatory movements of pusher 4 per unit of time were to equal the number of reciprocatory movements of the pusher 15. Such mode of operation can be readily achieved by utilizing any suitable control unit (a control unit is shown schematically in FIG. 3, as at 55) which regulates the operation of valves for admission of pressurized fluid into and for evacuation of fluid from the chambers of the cylinders 23 and the chambers of the cylinder or cylinders for piston rod or piston rods 22A forming part of means for reciprocating the pusher 4. The same applies for the frequency or reciprocatory movement of pushers 15 and 15′, i.e., the pusher 15′ can complete several forward and return strokes during each forward and return stroke of the pusher 15.

The improved apparatus can be modified in a number of additional ways without departing from the spirit of the invention. For example, if it is desired or necessary to further reduce the percentage of liquid in the solid bulk material which leaves the apparatus, the transporting unit 8' can be followed by one or more additional transporting units which may be similar or analogous to the unit 8 or 8'. The number of transporting units depends on the desired degree of segregation of liquid as well as on the desired distance between the vessel 4 and the locus where the slag leaves the apparatus. For example, if the apparatus is to comprise three transporting units, the bottom wall of the unit 8' resembles the bottom wall 17 of the unit 8 and the third unit (not shown) includes a pusher which is caused to reciprocate along the upper side of the bottom wall 28. The pusher of the third unit is held in the retracted position when the pusher 15' reaches the forward end of its material-advancing stroke and vice versa. Also, the frequency of reciprocatory movement of the pusher in the third unit can be a whole multiple of the frequency of reciprocatory movement of pusher 15'. The provision of a third transporting unit renders it possible to segregate additional quantities of liquid from slag as well as to achieve an even higher uniformity of the layer of slag which advances toward and overflows the edge 33 of the bottom wall 28.

The provision of means for intercepting the segregated liquid is not absolutely necessary, i.e., the bottom wall 28 could consist of a foraminous material to allow the segregated liquid to pass therethrough. However, a bottom wall 28 which is not permeable to liquids and is designed and mounted to advance the segregated liquid into the trough 29 is desirable and advantageous because the segregated liquid invariably contains smaller particles of slag and, therefore, such liquid would be likely to contaminate the area around and below the apparatus.

The means for reciprocating the pushers 4, 15 and 15' can be modified in a number of ways. For example, the fluid-operated (hydraulic or pneumatic) motors shown in FIG. 3 can be replaced with rack and pinion drives or the like. The illustrated reciprocating means are preferred at this time due to their simplicity and reliability. Furthermore, the coupling of piston rods 22, 22' only to the rear end portions of the respective pushers 15, 15' is desirable on the additional ground that the piston rods maintain the rear portions of such pushers in engagement with rear guides 14, 14' while causing the front portions of the pushers (i.e., the respective shoes) to bear against the upper sides of the respective bottom walls 17 and 28. The shoes of the pushers 15 and 15' are provided with suitable cutouts for the corresponding front guides 19 and 19', and such shoes are not in sealing engagement with the respective bottom walls so as to allow the segregated liquid to flow backwards toward the trough 29.

As mentioned above, the strokes of the pushers 15 and 15' are shorter than the length of the respective bottom walls 17 and 28. Consequently, the material which accumulates in front of the guides 19, 19' forms two layers whose height normally decreases in a direction toward the respective overflow edge 26, 33 and the leader of each such layer overflows onto the next-following bottom wall or leaves the apparatus whenever the respective pusher performs a forward stroke. Such mode of operation also contributes to uniform distribution of material which overflows the edges 26 and 33. The proturberances 27 and 27' prevent the tapering layers from sliding backwards, i.e., away from the respective overflow edges, while the respective pistons perform their return strokes.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and, therefore, such adaptations should and are intended to be comprehended within the meaning and range of equivalence of the claims.

What is claimed is:

1. Apparatus for processing slag which issues from an industrial furnace or the like, comprising a liquid-containing quenching vessel for reception of slag; a duct having an inlet in communication with said vessel and a discharge end remote from said inlet; means for advancing quenched slag from said vessel into said duct so that the slag is caused to overflow said discharge end; and means for transporting the overflowing slag, including an elongated receptacle having a rear portion below said discharge end and a front portion at a level above said rear portion, a pusher reciprocable in said receptacle between a retracted position behind said discharge end and a forward position, and means for reciprocating said pusher between said positions so that the pusher advances overflowing slag in said receptacle toward said front portion during each movement from said retracted position.

2. Apparatus as defined in claim 1, wherein said reciprocating means includes means for moving said pusher between said positions at a first frequency, said advancing means comprising a second pusher which is reciprocable between a retracted and a forward position and means for reciprocating said second pusher at a second frequency, said first frequency being $n$ times said second frequency wherein $n$ is a whole number including one.

3. Apparatus as defined in claim 2, wherein said reciprocating means include devices for maintaining said first mentioned pusher in the retracted position when said second pusher approaches or reaches said forward position and vice versa.

4. Apparatus as defined in claim 1, wherein said front portion of said receptacle has a discharge end where the slag overflows from said receptacle during movement of said pusher from said retracted position and further comprising means for transporting slag which overflows from said receptacle, including a second elongated receptacle having a rear portion below said last mentioned discharge end and a front portion at a level above said last mentioned rear portion, a second pusher reciprocable in said second receptacle between a retracted position behind said last mentioned discharge end and a forward position, and means for reciprocating said second pusher between the respective positions so that the second pusher advances overflowing slag toward the front end of said second receptacle during each movement from the retracted position thereof.

5. Apparatus as defined in claim 4, wherein said first mentioned and said last mentioned reciprocating means comprise devices for maintaining said first mentioned pusher in retracted position when said second pusher approaches or reaches its forward position and vice versa.

6. Apparatus as defined in claim 1, further comprising means for intercepting the liquid which is entrained by the overflowing slag beyond said discharge end.

7. Apparatus as defined in claim 6, wherein said intercepting means includes a trough at a level below said receptacle and means for directing liquid into said trough.

8. Apparatus as defined in claim 6, wherein the slag which overflows from said duct contains larger and smaller particles and said receptacle includes a bottom wall which slopes downwardly from said front toward said rear portion of said receptacle, said bottom wall forming part of said intercepting means and having an upper side along which the liquid which overflows with said particles trickles downwardly and on which said smaller particles tend to accumulate while the pusher advances the larger particles toward and beyond said front portion, and further comprising means for entraining said smaller particles along said upper side and away from said front portion including at least one scraper and means for moving said scraper toward said front portion while maintaining the scraper out of contact with said upper side and away from said front portion while maintaining said scraper in contact with said upper side.

9. Apparatus as defined in claim 8, wherein said moving means includes at least one arm articulately connecting said scraper to said pusher, said scraper being located behind said pusher, as considered in the direction of movement of said pusher from the retracted position thereof.

10. Apparatus as defined in claim 9, wherein said entraining means further comprises means for lifting said scraper off said upper side during each movement of said pusher from said retracted position.

11. Apparatus as defined in claim 10, wherein said lifting means comprises at least one rail having a front portion spaced apart from said upper side and a rear portion normally contacting said upper side, and means for pivotably supporting said rail in the region of said front portion thereof, said scraper being arranged to lift said rear portion of said rail off said upper side during movement of said pusher to said retracted position and to slide on top of said rail during movement of said pusher to said forward position.

12. Apparatus as defined in claim 11, further comprising means for yieldably biasing said rear portion of said rail against said upper side.

13. Apparatus as defined in claim 6 for processing slag consisting of larger particles which are sufficiently small to be bypassed by said pusher so that such smaller particles are intercepted with the liquid, said intercepting means including a trough which collects intercepted liquid and said additional particles and conveyor means for evacuating such additional particles from said trough.

14. apparatus as defined in claim 13, wherein said conveyor means comprises a rotary feed screw.

15. Apparatus as defined in claim 13, further comprising a second trough having a first portion communicating with said first mentioned trough and positioned to receive additional particles which are evacuated by said conveyor and a second portion at a level above said first portion, and means for conveying said additional particles in said second trough in a direction toward and beyond said second portion.

16. Apparatus as defined in claim 1, further comprising guide means including devices for confining said pusher to reciprocatory movement between said retracted and forward positions.

17. Apparatus as defined in claim 16, wherein said devices include a rear guide located at a level above said pusher and a front guide disposed in said receptacle in the region of said front portion, said pusher having a rear portion which is reciprocable along said rear guide and a front portion which is reciprocable along said front guide, said reciprocating means comprising a follower coupled to said rear portion of said pusher and said receptacle including a side wall having a guide slot for said follower, said reciprocating means further comprising motor means operative to move said follower back and forth lengthwise of said slot.

18. Apparatus as defined in claim 17, wherein said receptacle comprises two substantially parallel side walls and said guides are disposed substantially midway between said side walls.

19. Apparatus as defined in claim 17, wherein said motor comprises a fluid-operated cylinder and piston unit.

20. Apparatus as defined in claim 1, wherein said receptacle has a bottom wall along which said pusher moves between said retracted and forward positions, said front portion of said bottom wall having a discharge end and said pusher being remote from said last mentioned discharge end in said forward position thereof.

21. Apparatus as defined in claim 20, wherein said bottom wall has a upper side provided with slag-retaining protuberances on that part of said front portion thereof which is located between said last mentioned discharge end and said pusher in the forward position of said pusher, said protuberances preventing the slag from moving rearwardly toward the discharge end of said duct during movement of said pusher from said forward position.

22. Apparatus as defined in claim 1, further comprising means for stripping slag off said pusher movement from said forward position.

23. Apparatus as defined in claim 22, wherein said pusher has an upper side and said stripping means comprises a member pivotably secured to said duct and resting on the upper side of said pusher behind said discharge end.

* * * * *

UNITED STATES PATENT AND TRADEMARK OFFICE

CERTIFICATE OF CORRECTION

PATENT NO. : 4,073,480

DATED : February 14, 1978

INVENTOR(S) : Johannes Josef Martin and Erich Weber

It is certified that error appears in the above-identified patent and that said Letters Patent are hereby corrected as shown below:

Col. 11, line 48, "larger particles" should read --larger particles and additional particles--.

Signed and Sealed this

*Twenty-third* Day of *October 1979*

[SEAL]

*Attest:*

RUTH C. MASON
*Attesting Officer*

LUTRELLE F. PARKER
*Acting Commissioner of Patents and Trademarks*